US009420375B2

(12) United States Patent
Patwardhan et al.

(10) Patent No.: US 9,420,375 B2
(45) Date of Patent: Aug. 16, 2016

(54) METHOD, APPARATUS, AND COMPUTER PROGRAM PRODUCT FOR CATEGORICAL SPATIAL ANALYSIS-SYNTHESIS ON SPECTRUM OF MULTICHANNEL AUDIO SIGNALS

(71) Applicant: Nokia Technologies Oy, Espoo (FI)

(72) Inventors: Pushkar Prasad Patwardhan, Maharashtra (IN); Ravi Shenoy, Karnataka (IN)

(73) Assignee: Nokia Technologies Oy, Espoo (FI)

( * ) Notice: Subject to any disclaimer, the term of this patent is extended or adjusted under 35 U.S.C. 154(b) by 214 days.

(21) Appl. No.: 14/039,357

(22) Filed: Sep. 27, 2013

(65) Prior Publication Data

US 2014/0177845 A1 Jun. 26, 2014

(30) Foreign Application Priority Data

Oct. 5, 2012 (IN) ..... 4164/CHE/2012

(51) Int. Cl.

| | |
|---|---|
| ***H04R 5/04*** | (2006.01) |
| ***G10L 19/008*** | (2013.01) |
| ***G10L 19/02*** | (2013.01) |
| ***G10L 19/20*** | (2013.01) |
| ***H04S 7/00*** | (2006.01) |

(52) U.S. Cl.

CPC ..... *H04R 5/04* (2013.01); *G10L 19/008* (2013.01); *G10L 19/02* (2013.01); *G10L 19/20* (2013.01); *H04S 7/30* (2013.01); *H04S 2400/01* (2013.01); *H04S 2420/01* (2013.01)

(58) Field of Classification Search

None

See application file for complete search history.

(56) References Cited

U.S. PATENT DOCUMENTS

| | | | | |
|---|---|---|---|---|
| 5,040,217 | A * | 8/1991 | Brandenburg et al. | 704/200.1 |
| 5,583,967 | A * | 12/1996 | Akagiri | 704/200.1 |
| 5,737,718 | A * | 4/1998 | Tsutsui | 704/205 |

(Continued)

FOREIGN PATENT DOCUMENTS

| | | |
|---|---|---|
| GB | 2467534 | 8/2010 |
| WO | WO 01/49073 A2 | 7/2001 |

(Continued)

OTHER PUBLICATIONS

Extended European Search Report received for corresponding European Application No. 13184236.1-1910, dated Dec. 20, 2013, 8 pages.

(Continued)

*Primary Examiner* — Peter Vincent Agustin

(74) *Attorney, Agent, or Firm* — Alston & Bird LLP

(57) ABSTRACT

A method, apparatus and computer program product are therefore provided according to an example embodiment of the present invention in order to perform categorical analysis and synthesis of a multichannel signal to synthesize binaural signals and extract, separate, and manipulate components within the audio scene of the multichannel signal that were captured through multichannel audio means. In the context of a method, a multichannel signal is received. The method may include computing the spectrum for the multichannel signal, determining tonality of bands within the spectrum, and generating a band structure for the spectrum. The method may also include performing spatial analysis of the bands, performing source filtering using the bands, performing synthesis on the filtered band components, and generating an output signal. A corresponding apparatus and a computer program product are also provided.

20 Claims, 9 Drawing Sheets

(56) References Cited

U.S. PATENT DOCUMENTS

| | | | | |
|---|---|---|---|---|
| 5,870,703 | A * | 2/1999 | Oikawa et al. | 704/200.1 |
| 6,061,649 | A * | 5/2000 | Oikawa et al. | 704/226 |
| 6,064,955 | A * | 5/2000 | Huang et al. | 704/208 |
| 7,559,181 | B2 | 7/2009 | Estes et al. | |
| 2003/0123574 | A1 | 7/2003 | Simeon et al. | |
| 2003/0149559 | A1* | 8/2003 | Lopez-Estrada | 704/200.1 |
| 2003/0223593 | A1* | 12/2003 | Lopez-Estrada | 381/94.2 |
| 2003/0233234 | A1* | 12/2003 | Truman et al. | 704/256 |
| 2003/0233236 | A1* | 12/2003 | Davidson et al. | 704/258 |
| 2004/0243328 | A1* | 12/2004 | Rapp et al. | 702/71 |
| 2007/0174052 | A1* | 7/2007 | Manjunath et al. | 704/219 |
| 2008/0010063 | A1* | 1/2008 | Komamura | 704/226 |
| 2008/0031462 | A1 | 2/2008 | Walsh et al. | |
| 2008/0056517 | A1 | 3/2008 | Algazi et al. | |
| 2009/0110207 | A1* | 4/2009 | Nakatani et al. | 381/66 |
| 2009/0271204 | A1 | 10/2009 | Tammi | |
| 2009/0304203 | A1* | 12/2009 | Haykin et al. | 381/94.1 |
| 2011/0106543 | A1 | 5/2011 | Jaillet et al. | |
| 2011/0202352 | A1* | 8/2011 | Neuendorf et al. | 704/500 |
| 2014/0177845 | A1* | 6/2014 | Patwardhan et al. | 381/17 |

FOREIGN PATENT DOCUMENTS

| | | | |
|---|---|---|---|
| WO | 2007028250 | | 3/2007 |
| WO | WO 2008/006938 | A1 | 1/2008 |
| WO | WO 2009/048239 | A2 | 4/2009 |

OTHER PUBLICATIONS

Patwardhad Pushkar P. et al. "Detechtion of 1-15 Sinusoids Using Statistical Goodness-of-Flt Test", AES Convention 134, 20130501, AES, 60 East 42nd Street, room 2520 New York, 10165-2520, USA, May 4, 2013.

Cobos, Maximo et al.; "A Sparsity-Based Approach to 3D Binaural Sound Synthesis Using Time-Frequency Array Processing"; EURASIP Journal on Advances in Signal Processing; vol. 2010, Article ID 415840; 13 pages.

Gomex, Emilia et al.; "Comparative Analysis of Music Recordings from Western and Non-Western Traditions by Automatic Tonal Feature Extraction"; Empirical Musciology Review; vol. 3, No. 3; 2008; pp. 140-156.

Lanyi, G. et al.; "Tone Detection Via Incoherent Averaging of Fourier Transforms to Support the Automated Spacecraft-Monitoring Concept"; TDA Progress Report 42-129; May 15, 1997; pp. 1-22.

Thomas, David J.; "Spectrum Estimation and Harmonic Analysis"; Proceedings of the IEEE; vol. 70, No. 9; Sep. 1982; pp. 1055-1096.

Griffin, Daniel W. et al.; "A New Model-Based Speech Analysis/Synthesis System"; IEEE International Conference on Acoutics, Speech and Signal Processing; Tampa, Florida; 1985; pp. 513-516.

McAulay, Robert J. et al.; "Speech Analysis/Synthesis Based on a Sinusoidal Representation"; IEEE Transactions on Acoustics, Speech, and Signal Processing; vol. ASSP-34, No. 4; Aug. 1986; pp. 744-754.

Smith, Julius O. et al.; "An Analysis/Synthesis Program for Non-Harmonic Sounds Based on a Sinusoidal Representation"; Proceedings of the International Computer Music Conference; 1987; pp. 290-297.

Lee, Keun-Sup et al.; "Effective Tonality Detection Algorithm Based on Spectrum Energy in Perceptual Audio Coder"; 117th Convention; Oct. 2004.

Faller, C.; "Parametric Multi-Channel Audio Coding: Synthesis of Coherence Cues"; IEEE Trans. On Speech and Audio Proc.; vol. 14, No. 1; pp. 299-310; Jan. 2006.

Pulkki, Ville et al.; "Directional Audio Coding: Filterbank and STFT-based Design"; 120$^{th}$ Convention; May 2006.

Brandenburg, K. et al.; "Second Generation Perceptual Audio Coding: the Hybrid Coder"; 88th conv. Of the AES; Mar. 1990; pp. 1-13.

Ferreira, Anibal J.S. et al.; "Tonality Detection in Perceptual Coding of Audio"; 98th Conv. AES; Feb. 1995; pp. 1-15.

Depalle, Ph et al.; "Extraction of Spectral Peak Parameters Using a Short-Time Fourier Transform Modeling and No Sidelobe Windows"; IEEE 1997 Workshop on Applications of Signal Processing to Audio and Acoustics; Mohonk, NY; 1997; pp. 1-4.

Desainte-Catherine, Myriam et al.; "High-Precision Fourier Analysis of Sounds Using Signal Derivatives"; Journal of Acoustic Engineering Society; vol. 48, No. 7; Jul./Aug. 2000; pp. 654-667.

Kulesza, Maciej et al.; "Tonality Estimation and Frequency Tracking of Modulated Tonal Components"; J. Audio Eng. Soc.; vol. 57, No. 4; Apr. 2009; pp. 221-236.

Pettitt, Anthony; "Goodness-of-fit Tests for Discrete and Censored Data, Based on the Empirical Distribution Function"; Thesis Submitted to the University of Nottingham for the degree of Doctor of Philosophy, Oct. 1973; 224 pages.

* cited by examiner

METHOD, APPARATUS, AND COMPUTER PROGRAM PRODUCT FOR CATEGORICAL SPATIAL ANALYSIS-SYNTHESIS ON SPECTRUM OF MULTICHANNEL AUDIO SIGNALS

TECHNOLOGICAL FIELD

An example embodiment of the present invention relates generally to analysis and synthesis of multichannel signals.

BACKGROUND

There are several methods to generate a binaural audio signal from a multichannel signal that are based on a fixed filterbank structure. Some other variations include using a non-uniform filterbank structure or structures based on alternative auditory scales. Although binaural signals can be satisfactorily generated, such methods are not suitable to manipulating the components present within the audio signal. The spatial analysis of a multichannel signal is performed on a single band which may contain contributions from multiple auditory sources (i.e. a multipitch signal could have very closely spaced harmonics). It may not be possible to get the spatial distribution of the different components present in the entire spectrum of the signal. Performance of pitch synchronous analysis of such signals is restricted to signals containing a single pitch, since multipitch signals tend to be difficult to analyze and require complex algorithms.

Many signal processing applications require detecting a tone and estimating its location from a signal. Some examples where detection of tones from audio signal spectrum is required include sinusoidal modeling requiring detection of spectral peaks and psychoacoustic models requiring identification of tone and noise like components in spectrum to apply the appropriate masking rules. A voice signal is characterized by harmonic structure and detecting harmonicity in spectrum requires detection of tone. Further, most musical instruments produce sounds containing tonal structure (it could be harmonic or inharmonic). Alternative applications include detection of interfering tones or selecting tone from noisy background or estimation of periodicity.

Performance of tone detection methods can suffer due to noise. Some tonal component detection methods may require estimating approximate pitch in a time domain and then refining the spectral peak estimate in a spectral domain. In such scenarios, performance of pitch detection can degrade in the presence of multiple periodicities in the signal. Many techniques are based on distance measures or correlation based or geometrical and search based methods to detect the tones and require comparison with a threshold for some stage of decision making. Thresholds on spectral mismatches are prone to errors in the presence of noise and also need normalization based on signal strengths.

BRIEF SUMMARY

A method, apparatus and computer program product are therefore provided according to an example embodiment of the present invention in order to perform categorical analysis and synthesis of a multichannel signal to synthesize binaural signals and extract, separate, and manipulate components within the audio scene of the multichannel signal that were captured through multichannel audio means.

In one embodiment, a method is provided that at least includes receiving a multichannel signal, computing the spectrum for the multichannel signal, determining tonality of bands within the spectrum, and generating a band structure for the spectrum. The method of this embodiment also includes performing spatial analysis of the bands, performing source filtering using the bands, performing synthesis on the filtered band components, and generating an output signal.

In some embodiments, the method may further include determining the tonality of bands within the spectrum on only one channel in the multichannel signal. In some embodiments, determining the tonality of bands within the spectrum comprises determining if the band is tonal or non-tonal. In some embodiments, the width of the bands may be variable. For example one of the choices for widths of the bands may be {29.6 Hz, 41 Hz, 52.75 Hz, 64.5 Hz, 76 Hz}.

In some embodiments, the method may further include a tonality determination of bands in the spectrum based on statistical goodness of fit tests. In some embodiments, the tonality determination comprises comparing a spectral component distribution in a band to an expected spectral component distribution. In some embodiments, the expected spectral component distribution may be generated by an ideal sinusoid. In some embodiments, comparison of the spectral component distributions may include using a test of goodness of fit, such as a chi-square test.

In some embodiments, the method may further include generating a band structure for the spectrum by categorizing bands as tonal or non-tonal and computing upper and lower limits of tonal and non-tonal bands. In some embodiments, generating a band structure for the spectrum may include consolidating multiple continuous tonal bands into a single band.

In some embodiments, spatial analysis of the bands may include determining the spatial location of a source. In some embodiments, source filtering of the bands may include processing the bands with head related transfer function (HRTF) filters. In some embodiments, synthesis on the filtered band components may include applying an inverse Discrete Fourier transform and applying add and overlap synthesis. In some embodiments, the output signal may be an individual source in an audio scene of the multichannel signal, a binaural signal, source relocation within an audio scene of the multichannel signal, or directional component separation.

In another embodiment, an apparatus is provided that includes at least one processor and at least one memory including computer program instructions with the at least one memory and the computer program instructions configured to, with the at least one processor, cause the apparatus at least to receive a multichannel signal, compute the spectrum for the multichannel signal, determine tonality of bands within the spectrum, and generating a band structure for the spectrum. The at least one memory and the computer program instructions are also configured to, with the at least one processor, cause the apparatus at least to perform spatial analysis of the bands, perform source filtering of the bands, perform synthesis on the filtered band components, and generate an output signal.

In a further embodiment, a computer program product is provided that includes at least one non-transitory computer-readable storage medium bearing computer program instructions embodied therein for use with a computer with the computer program instructions including program instructions configured to receive a multichannel signal, compute the spectrum for the multichannel signal, determine tonality of bands within the spectrum, and generating a band structure for the spectrum. The program instructions are further configured to perform spatial analysis of the bands, perform source filtering of the bands, perform synthesis on the filtered band components, and generate an output signal.

In another embodiment, an apparatus is provided that includes at least means for receiving a multichannel signal, means for computing the spectrum for the multichannel signal, means for determining tonality of bands within the spectrum, and means for generating a band structure for the spectrum. The apparatus of this embodiment also includes means for performing spatial analysis of the bands, means for performing source filtering of the bands, means for performing synthesis on the filtered band components, and means for generating an output signal.

BRIEF DESCRIPTION OF THE DRAWINGS

Figure 1:
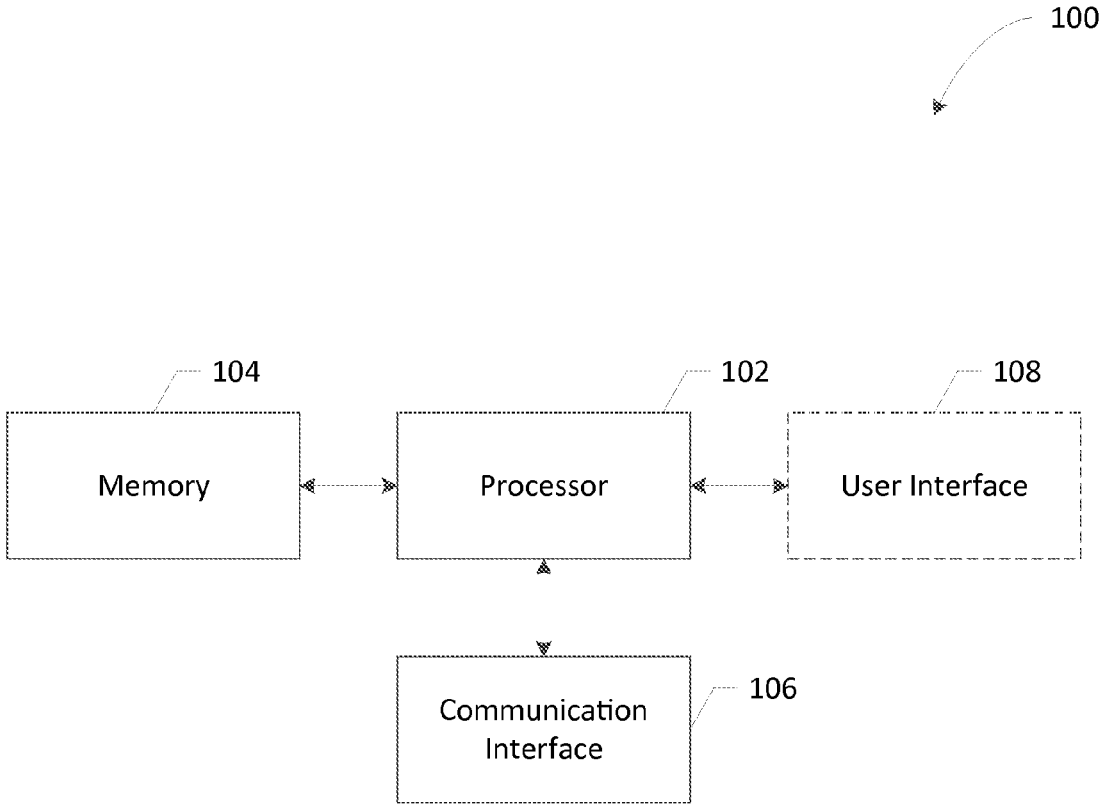
Figure 2:
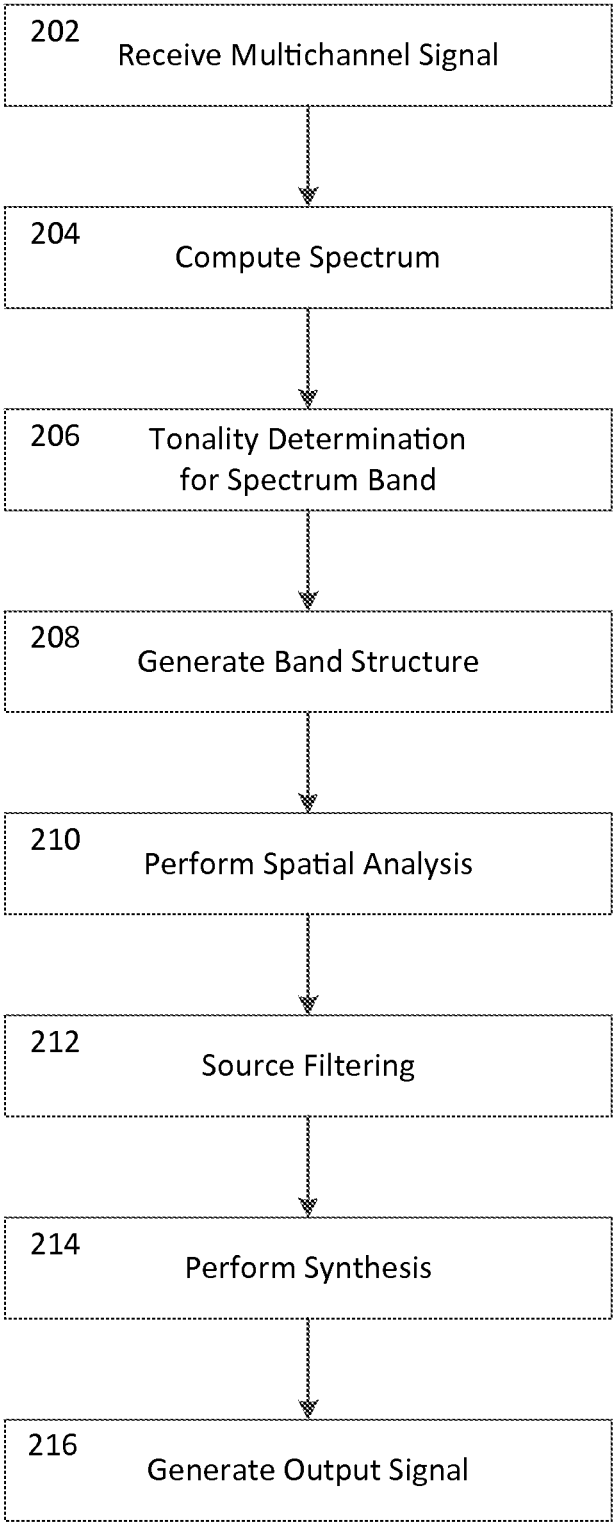
Figure 3:
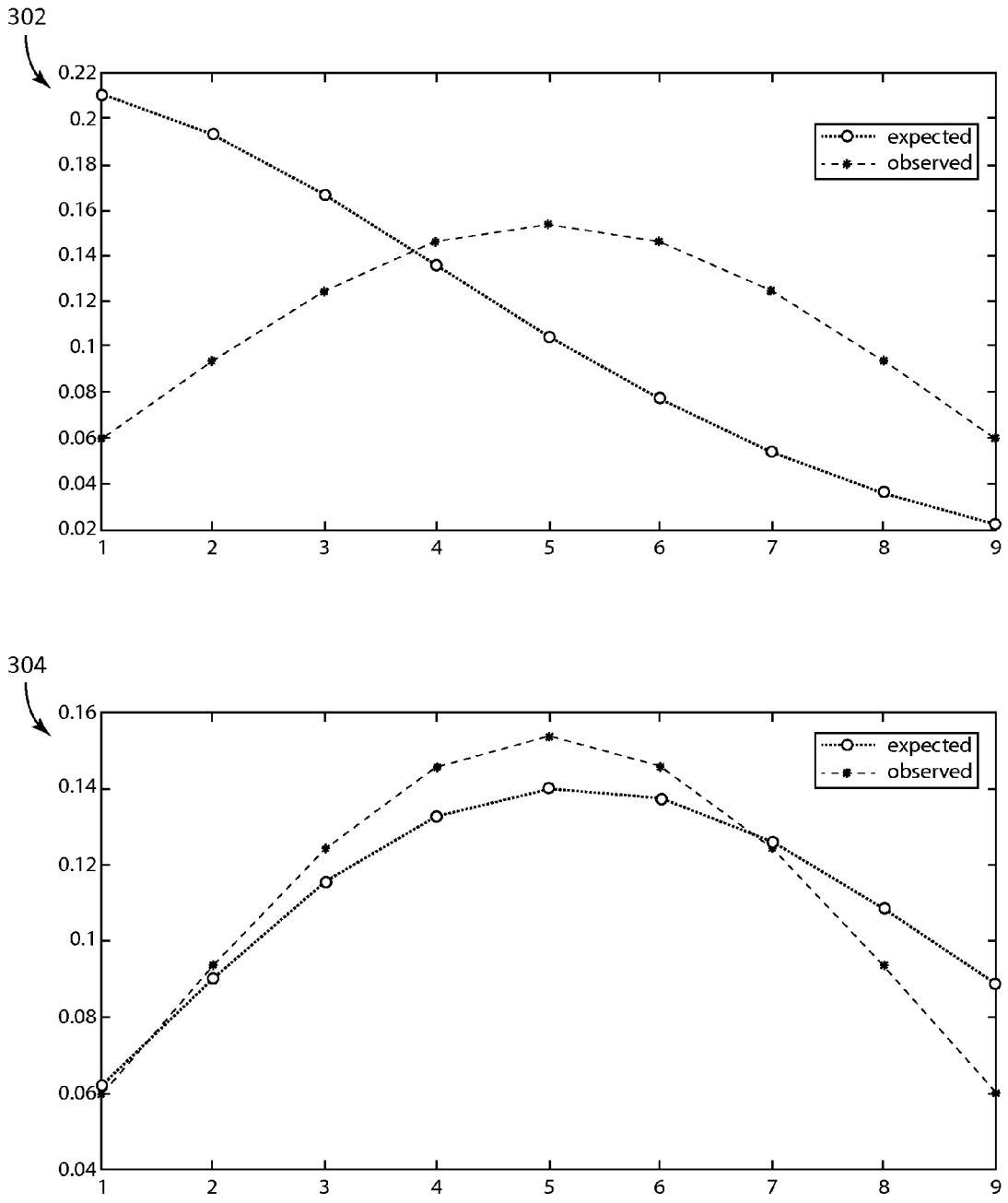
Figure 4:
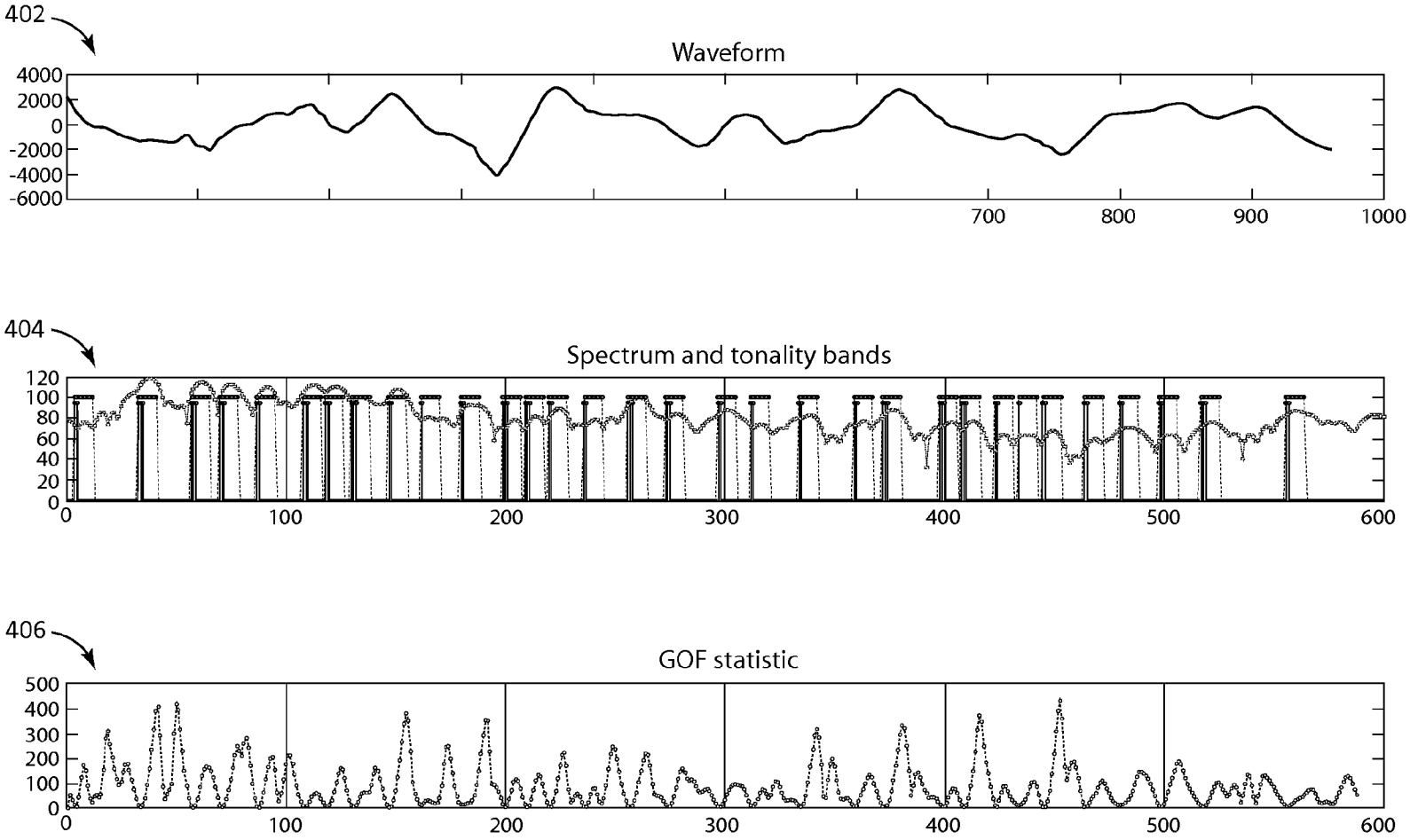
Figure 5:
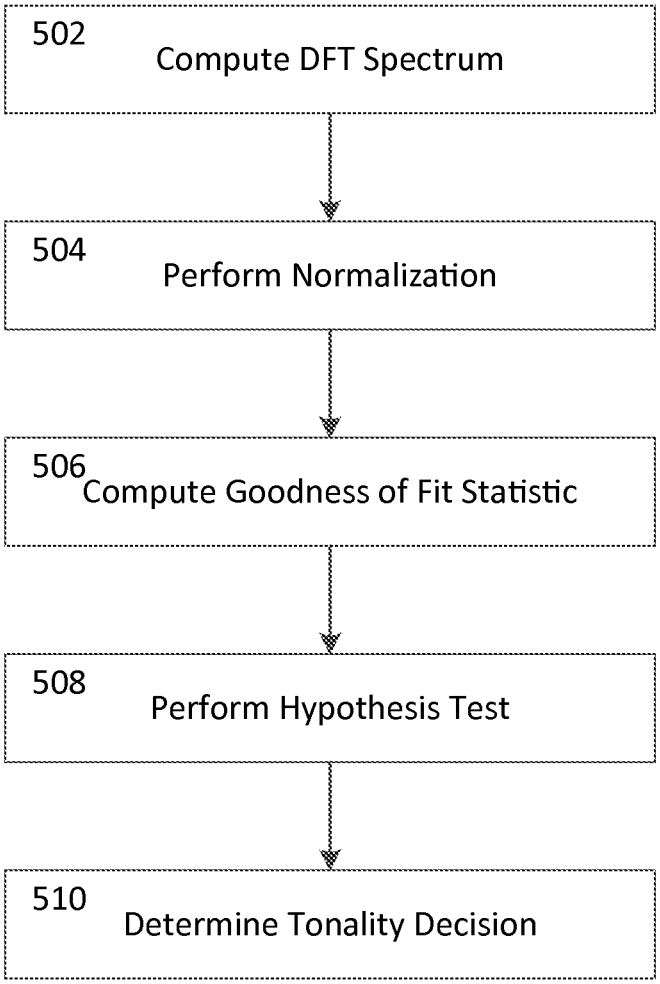
Figure 6:
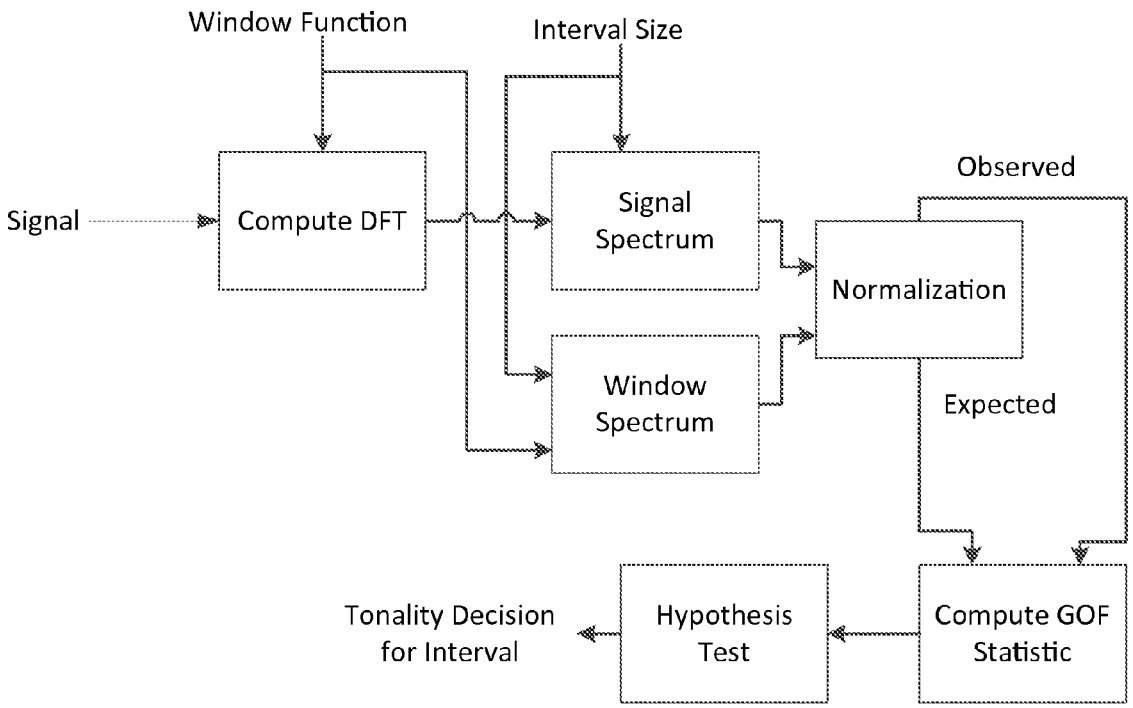
Figure 7:
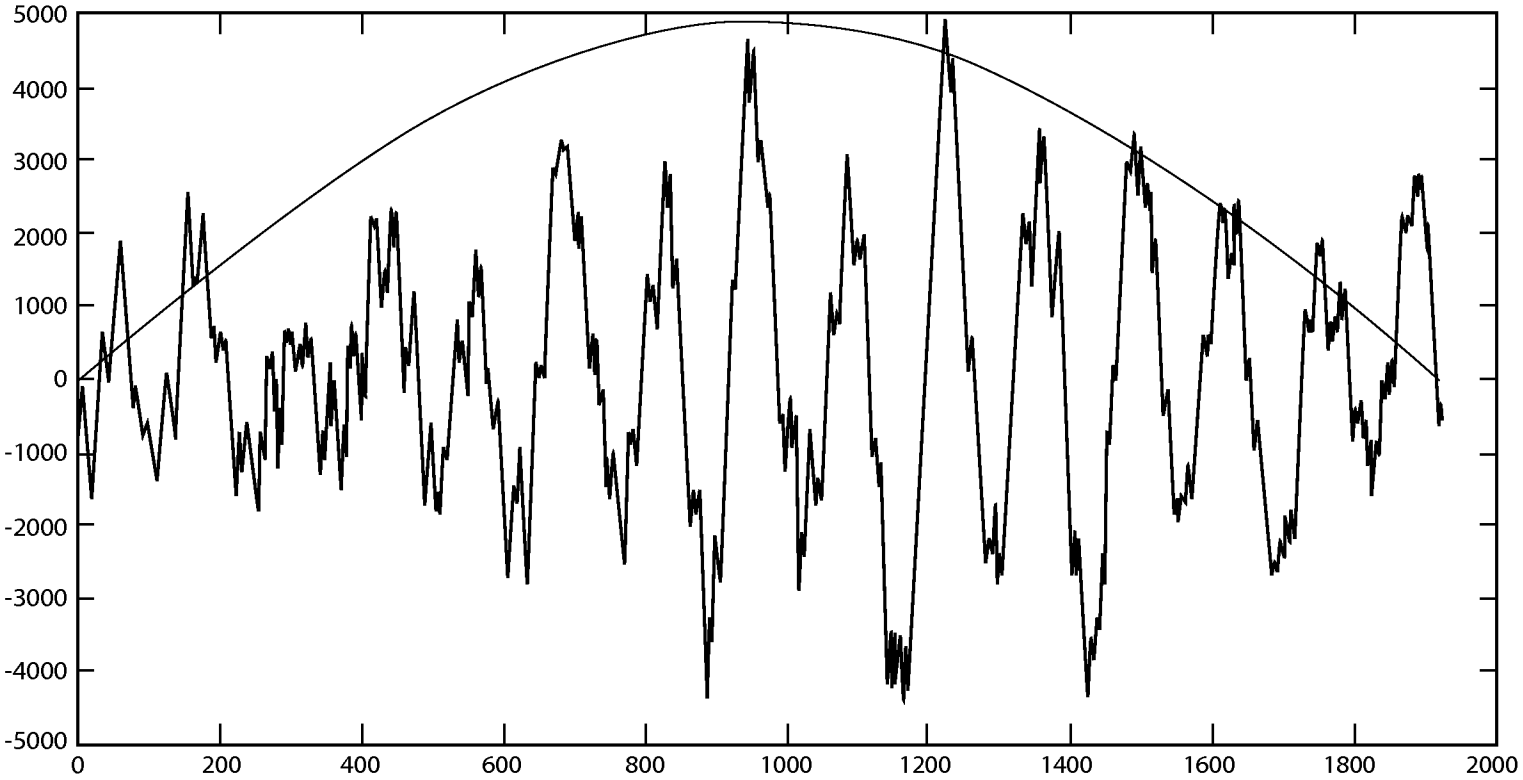
Figure 8:
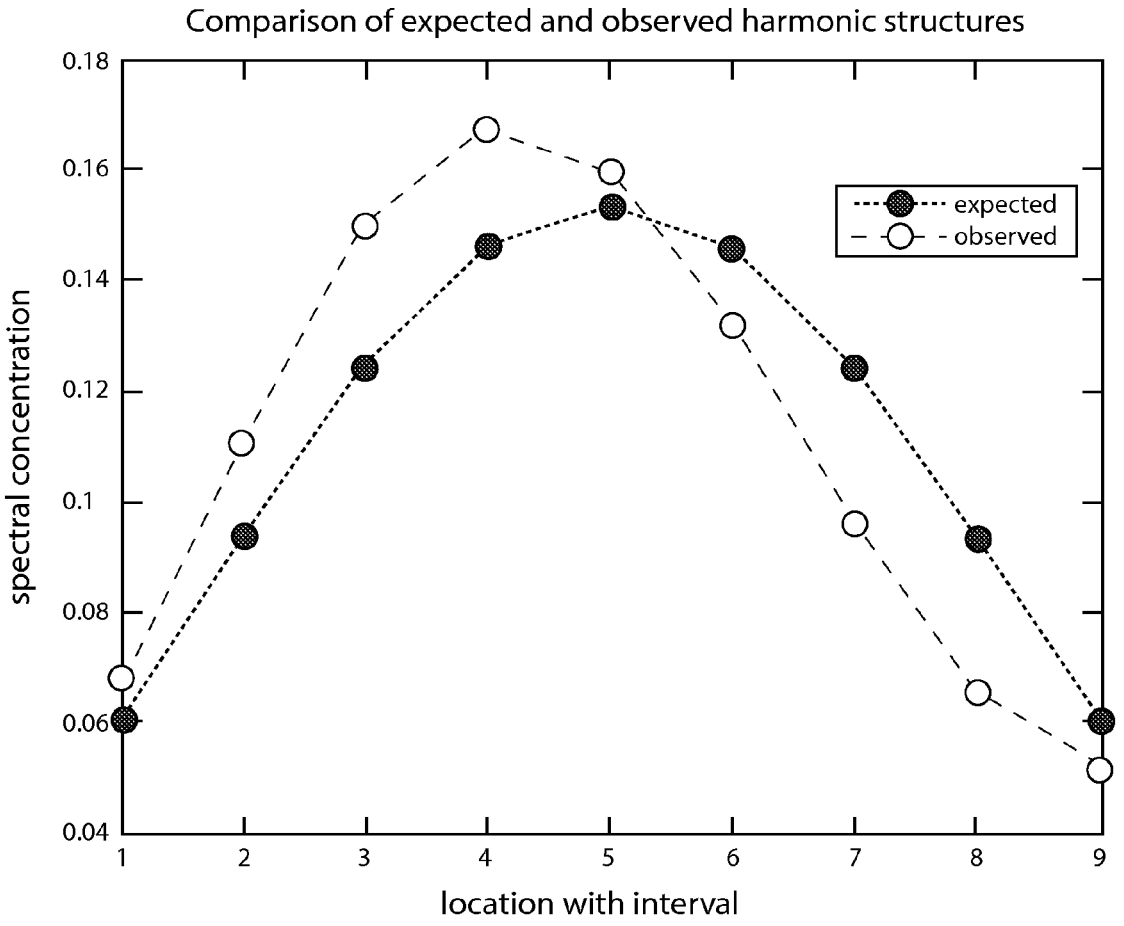
Figure 9:
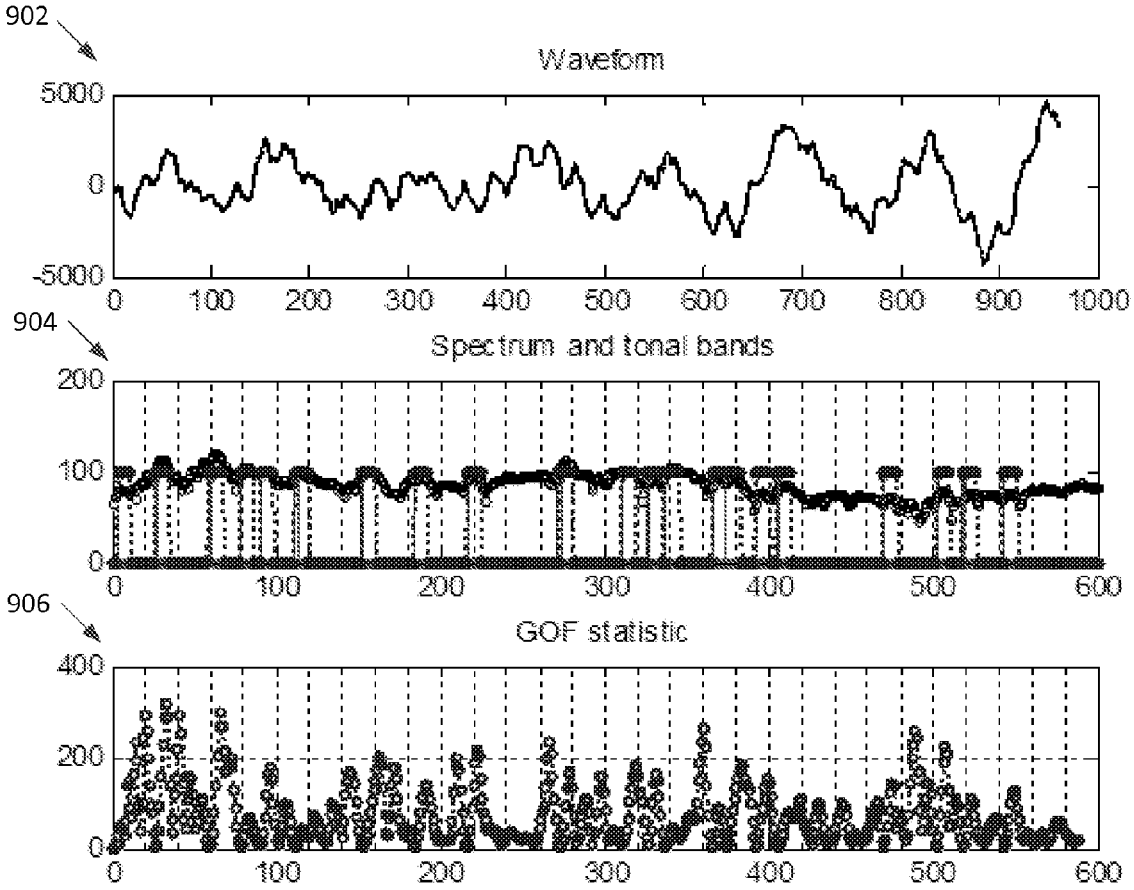

Having thus described certain embodiments of the invention in general terms, reference will now be made to the accompanying drawings, which are not necessarily drawn to scale, and wherein:

FIG. 1 is a block diagram of an apparatus that may be specifically configured in accordance with an example embodiment of the present invention;

FIG. 2 is a flow chart illustrating operations performed by an apparatus of FIG. 1 that is specifically configured in accordance with an example embodiment of the present invention;

FIG. 3 illustrates sample comparisons of actual and ideal distributions in accordance with an example embodiment of the present invention;

FIG. 4 illustrates example plots of the signal and analysis performed by an apparatus in accordance with an example embodiment of the present invention;

FIG. 5 is a flow chart illustrating operations for tonality determination performed by an apparatus in accordance with an example embodiment of the present invention;

FIG. 6 is a functional block diagram illustrating operations for tonality determination performed by an apparatus in accordance with an example embodiment of the present invention;

FIG. 7 illustrates a waveform of a signal and the window in accordance with an example embodiment of the present invention; and FIG. 8 illustrates a comparison of expected and observed spectral distributions in accordance with an example embodiment of the present invention; and FIG. 9 illustrates an example of the output that may be generated by operations performed by an apparatus in accordance with an example embodiment of the present invention.

DETAILED DESCRIPTION

Some embodiments of the present invention will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. As used herein, the terms "data," "content," "information," and similar terms may be used interchangeably to refer to data capable of being transmitted, received and/or stored in accordance with embodiments of the present invention. Thus, use of any such terms should not be taken to limit the spirit and scope of embodiments of the present invention.

Additionally, as used herein, the term 'circuitry' refers to (a) hardware-only circuit implementations (e.g., implementations in analog circuitry and/or digital circuitry); (b) combinations of circuits and computer program product(s) comprising software and/or firmware instructions stored on one or more computer readable memories that work together to cause an apparatus to perform one or more functions described herein; and (c) circuits, such as, for example, a microprocessor(s) or a portion of a microprocessor(s), that require software or firmware for operation even if the software or firmware is not physically present. This definition of 'circuitry' applies to all uses of this term herein, including in any claims. As a further example, as used herein, the term 'circuitry' also includes an implementation comprising one or more processors and/or portion(s) thereof and accompanying software and/or firmware. As another example, the term 'circuitry' as used herein also includes, for example, a baseband integrated circuit or applications processor integrated circuit for a mobile phone or a similar integrated circuit in a server, a cellular network device, other network device, and/or other computing device.

As defined herein, a "computer-readable storage medium," which refers to a non-transitory physical storage medium (e.g., volatile or non-volatile memory device), can be differentiated from a "computer-readable transmission medium," which refers to an electromagnetic signal.

A method, apparatus and computer program product are provided in accordance with an example embodiment of the present invention to perform categorical analysis and synthesis of a multichannel signal to synthesize binaural signals and extract, separate, and manipulate components within the audio scene of the multichannel signal that were captured through multichannel audio means.

Embodiments of the present invention may perform analysis and synthesis of a multichannel signal to synthesize binaural signals and extract, separate, and manipulate components within the audio scene of the multichannel signal that were captured through multichannel audio means. Embodiments of the present invention do not require pitch estimation in time and frequency domains. The embodiments may perform spatial analysis categorically on the spectrum rather than on the entire spectrum. The categorization may be based on a tonal nature of regions or bands within the spectrum. The categorical analysis-synthesis enables various functions such as source separation, source manipulation, and binaural synthesis.

In some embodiments, spatial cues for the multichannel signal may be captured by analyzing fewer components (e.g. tonal components) in the spectrum, which are more relevant for carrying information about the direction. In some embodiments, operations may be more computationally efficient since only the bands specific to tonal regions need analysis and/or synthesis. Additionally, the tonality computation does not require pitch detection and is also suitable for use with multipitch signals.

In one embodiment, a method is provided that at least includes receiving a multichannel signal, computing the spectrum for the multichannel signal, determining tonality of bands within the spectrum, and generating a band structure for the spectrum. The method of this embodiment also includes performing spatial analysis of the bands, performing source filtering of the bands, performing synthesis on the filtered band components, and generating an output signal.

Further embodiments provide for determining tonality for regions of a spectrum by detecting peaks within a spectrum using a parametric statistical goodness of fit test. Such embodiments do not require apriori pitch estimation of temporal processing and use spectrum as input for the tonality detection. For example, even if a signal is a combination of harmonic and non-harmonic components, spectral peaks can be reliably estimated. The tonality detection operation is flexible enough to allow gradual tuning by changing its parameters.

Some embodiments of the present invention may use a statistical goodness of fit method for identifying tonality in the spectrum. The sum of two complex exponentials with the same frequency of oscillation would give two lines; one at +ve and one at −ve frequency, 0.5*(exp(−j\omega t)+exp (j\omega t)). Once windowed the lines smear and spectrum is given by the Discrete Fourier Transform (DFT) of the windowed signal. Smearing may also occur if the N in an N-point DFT is not large enough to have enough spectral resolution. In some embodiments, the ideal shape of the windowed spectrum of a tone is used as reference or expected spectral content distribution to which the region in the spectrum to be tested for tonality (or the observed distribution) is compared. In essence this process corresponds to comparing the shape of a region in a spectrum to an ideal spectral shape of a windowed tone. The interval over which the tonality is detected may be variable and can be changed based on the region in which it is applied. To be able to apply a statistical goodness of fit tests, however, the expected and observed sets of samples cannot be compared as they are; rather, they need to resemble discrete probability distributions. As such, the observed and expected distribution functions are normalized by using the sum of magnitude of their spectral values over the interval of comparison. This ensures that sum of the spectral samples sum up to unity.

In some embodiments, once such normalization is carried out a goodness of fit test may be performed. In example embodiments, this can be any of the well-known statistical tests such as Chi-Square, Anderson-Darling, or Kolmogorov-Smirnov test. Such tests require a statistic to be computed and hypothesis test to be carried out for a particular significance level. In an example embodiment, the NULL hypothesis is that a tonal component is present, but if the test statistic is higher than a threshold value (decided by the significance level) the NULL hypothesis is rejected. In an example embodiment, the statistic may be computed at every DFT bin value, when a tone is found the chi-square statistic takes a low value. This also means that the shape of spectral region found in a spectrum matches closely to the ideal harmonic at the selected significance level.

The statistical nature of test in such embodiments provides flexibility of tuning the whole procedure by various parameters, such as using different significance levels for different regions and using variable intervals across the spectrum over which a goodness of fit is carried out.

In some embodiments, the DFT bins where tones are found may be stored and used for further computation along with their corresponding interval sizes.

An embodiment of the present invention may include an apparatus 100 as generally described below in conjunction with FIG. 1 for performing one or more of the operations set forth by FIGS. 2 and 5 and also described below.

It should also be noted that while FIG. 1 illustrates one example of a configuration of an apparatus 100 for categorical analysis and synthesis of multichannel signals, numerous other configurations may also be used to implement other embodiments of the present invention. As such, in some embodiments, although devices or elements are shown as being in communication with each other, hereinafter such devices or elements should be considered to be capable of being embodied within the same device or element and thus, devices or elements shown in communication should be understood to alternatively be portions of the same device or element.

Referring now to FIG. 1, the apparatus 100 for analysis and synthesis of multichannel signals in accordance with one example embodiment may include or otherwise be in communication with one or more of a processor 102, a memory 104, a communication interface 106, and optionally, a user interface 108. In some embodiments the apparatus need not necessarily include a user interface, and as such, this component has been illustrated in dashed lines to indicate that not all instantiations of the apparatus includes this component.

In some embodiments, the processor (and/or co-processors or any other processing circuitry assisting or otherwise associated with the processor) may be in communication with the memory device via a bus for passing information among components of the apparatus. The memory device may include, for example, a non-transitory memory, such as one or more volatile and/or non-volatile memories. In other words, for example, the memory device may be an electronic storage device (e.g., a computer readable storage medium) comprising gates configured to store data (e.g., bits) that may be retrievable by a machine (e.g., a computing device like the processor). The memory device may be configured to store information, data, content, applications, instructions, or the like for enabling the apparatus to carry out various functions in accordance with an example embodiment of the present invention. For example, the memory device could be configured to buffer input data for processing by the processor 102. Additionally or alternatively, the memory device could be configured to store instructions for execution by the processor.

In some embodiments, the apparatus 100 may be embodied as a chip or chip set. In other words, the apparatus may comprise one or more physical packages (e.g., chips) including materials, components and/or wires on a structural assembly (e.g., a baseboard). The structural assembly may provide physical strength, conservation of size, and/or limitation of electrical interaction for component circuitry included thereon. The apparatus may therefore, in some cases, be configured to implement an embodiment of the present invention on a single chip or as a single "system on a chip." As such, in some cases, a chip or chipset may constitute means for performing one or more operations for providing the functionalities described herein.

The processor 102 may be embodied in a number of different ways. For example, the processor may be embodied as one or more of various hardware processing means such as a coprocessor, a microprocessor, a controller, a digital signal processor (DSP), a processing element with or without an accompanying DSP, or various other processing circuitry including integrated circuits such as, for example, an ASIC (application specific integrated circuit), an FPGA (field programmable gate array), a microcontroller unit (MCU), a hardware accelerator, a special-purpose computer chip, or the like. As such, in some embodiments, the processor may include one or more processing cores configured to perform independently. A multi-core processor may enable multiprocessing within a single physical package. Additionally or alternatively, the processor may include one or more processors configured in tandem via the bus to enable independent execution of instructions, pipelining and/or multithreading.

In an example embodiment, the processor 102 may be configured to execute instructions stored in the memory device 104 or otherwise accessible to the processor. Alternatively or additionally, the processor may be configured to execute hard coded functionality. As such, whether configured by hardware or software methods, or by a combination thereof, the processor may represent an entity (e.g., physically embodied in circuitry) capable of performing operations according to an embodiment of the present invention while configured accordingly. Thus, for example, when the processor is embodied as an ASIC, FPGA or the like, the processor may be specifically configured hardware for conducting the operations described herein. Alternatively, as another example, when the processor is embodied as an executor of software instructions, the instructions may specifically configure the processor to perform the algorithms and/or operations described herein when the instructions are executed. However, in some cases, the processor may be a processor of a specific device configured to employ an embodiment of the present invention by further configuration of the processor by instructions for performing the algorithms and/or operations described herein. The processor may include, among other things, a clock, an arithmetic logic unit (ALU) and logic gates configured to support operation of the processor.

Meanwhile, the communication interface 106 may be any means such as a device or circuitry embodied in either hardware or a combination of hardware and software that is configured to receive and/or transmit data from/to a network and/or any other device or module in communication with the apparatus 100. In this regard, the communication interface may include, for example, an antenna (or multiple antennas) and supporting hardware and/or software for enabling communications with a wireless communication network. Additionally or alternatively, the communication interface may include the circuitry for interacting with the antenna(s) to cause transmission of signals via the antenna(s) or to handle receipt of signals received via the antenna(s). In some environments, the communication interface may alternatively or also support wired communication. As such, for example, the communication interface may include a communication modem and/or other hardware/software for supporting communication via cable, digital subscriber line (DSL), universal serial bus (USB) or other mechanisms.

The apparatus 100 may include a user interface 108 that may, in turn, be in communication with the processor 102 to provide output to the user and, in some embodiments, to receive an indication of a user input. For example, the user interface may include a display and, in some embodiments, may also include a keyboard, a mouse, a joystick, a touch screen, touch areas, soft keys, a microphone, a speaker, or other input/output mechanisms. The processor may comprise user interface circuitry configured to control at least some functions of one or more user interface elements such as a display and, in some embodiments, a speaker, ringer, microphone and/or the like. The processor and/or user interface circuitry comprising the processor may be configured to control one or more functions of one or more user interface elements through computer program instructions (e.g., software and/or firmware) stored on a memory accessible to the processor (e.g., memory 104, and/or the like).

The method, apparatus, and computer program product may now be described in conjunction with the operations illustrated in FIG. 2. In this regard, the apparatus 100 may include means, such as the processor 102, the communication interface 106, or the like, for receiving multichannel signals for processing. See block 202 of FIG. 2. In one example embodiment, the input for the multichannel signal processing operations may comprise a multichannel signal made up of four audio channels captured through a four-microphone setup. In such an example embodiment, only three inputs are needed to estimate source directions in the azimuthal plane and the fourth microphone may be used if the elevation needs to be determined.

The apparatus 100 may further include means, such as the processor 102, the memory 104, or the like, for computing the spectrum of a received multichannel signal. See block 204 of FIG. 2. In some example embodiments, the spectrum computation may be performed on all the channels of the multichannel signal. In some example embodiments, a frame size of 20 ms (or 960 samples at 48 KHz) may be used for the analysis, a sine window of twice the frame size may be used, and an 8192-point Discrete Fourier Transform (DFT) may be computed.

As shown in block 206 of FIG. 2, the apparatus 100 may include means, such as the processor 102, the memory 104, or the like, for determining tonality for bands of the signal spectrum. In some embodiments, tonality determination may be performed on only one of the channels of the multichannel signal. Operations of block 206 may determine the category of the one or more bands of lines in the computed spectrum. In some embodiments, the width of a band may be variable and may be changed across the various regions of the spectrum. In some exemplary embodiments, a number of band sizes may be used, such as 29.6 Hz, 41 Hz, 52.75 Hz, 64.5 Hz and 76 Hz. In such an embodiment, the narrower bands may be suitable in lower frequency regions and the wider bands may be suitable in higher frequency regions. For example, in a lower frequency region, an embodiment may use 29.6 Hz and gradually increase to 76 Hz for the higher frequency regions.

Any of a variety of methods may be used to determine which bands of the spectrum are tonal, such as peak picking, F-ratio test, interpolation based techniques to determine spectral peaks. In an exemplary embodiment, the tonality of the bands in the spectrum may be based on statistical goodness of fit tests as described below.

Using a statistical goodness of fit test, tonality is detected by comparing the of spectral component distribution in a band (i.e. the observed distribution) to a spectral component distribution generated by an ideal sinusoid (i.e. the expected distribution). The comparison is carried out using chi-square test of goodness of fit. However, other possible goodness of tests such as Kolmogorov-Smirnov or Anderson-Darling may be used as well. A goodness of fit test is commonly used for comparing probability distributions; hence the first operation is to ensure that the functions to be compared have properties of probability density functions. This is achieved by normalizing the spectrum over the band by sum of its magnitudes in that band. A similar normalization is carried out on a Discrete Fourier Transform of the sine window centered on the harmonic. Once the two functions resemble probability density functions, a chi-square test is performed. The width of the band becomes the degrees of freedom for the chi-square distribution. In one example, the significance level is set to 10% but can be changed based on strictness of the test.

FIG. 3 illustrates some sample comparisons of actual and ideal distributions. For example, graph 302 of FIG. 3 illustrates a large mismatch between samples from the spectral component distribution of the spectrum (the observed distribution) and ideal the spectral component distribution (the expected distribution) and graph 304 of FIG. 3 illustrates a fairly close match between the spectral component distributions. The first graph 302 indicates the band under consideration is not tonal (a significant mismatch with respect to the expected distribution) while the second graph 304 shows a close match between the observed and expected distribution indicating a tonal component.

In an example embodiment, the statistic is computed as follows:

$$\chi^2 = \frac{\sum_{n=1}^{N} (S_o[n] - S_i[n])^2}{S_i[n]},$$

where $\chi^2$ is the chi-square statistic, $S_o$ and $S_i$ are the normalized observed and expected spectral magnitude distributions. $S_i$ is derived from the Discrete Fourier Transform samples of the sine window function (used for the Discrete Fourier Transform computation) centered on the harmonic, while $S_o$ is derived from the observed contiguous set of samples sampled in the Discrete Fourier Transform spectrum. 'n' is the interval size over which the statistic is computed. In one example, the interval size can be chosen from five different sizes. The 'n' also serves to determine the degree of chi-square function to choose for the hypothesis test. The $S_i$ and $S_o$ are not directly used from the window and signal themselves; rather they are normalized by the sum of magnitudes of the Discrete Fourier Transform samples over the interval. This is necessary in order to make them resemble frequency distribution and be able to apply the hypothesis testing.

The subplot 406 of FIG. 4 shows an example of the chi-square statistic at every Discrete Fourier Transform bin. The statistic dips where a strong tone is found. Based on the significance level for the hypothesis test, certain bands in the spectrum are categorized as tonal while others are categorized as non-tonal. In an example embodiment, the entire spectrum is scanned and the tonality statistic function is computed over the first 4000 Hz. In another example embodiment, the choice of a region in which the tonality determination is performed may be based on auditory masking principles. For example, regions with low strength lying in proximity to a strong component need not be scanned at all, which may result in a reduction in computational cost.

As shown in block 208 of FIG. 2, the apparatus 100 may include means, such as the processor 102, the memory 104, or the like, for generating the band structure for the spectrum using the determined category (i.e. tonal or non-tonal) for each band. In some example embodiments, the category of each band may be determined using a statistical goodness of fit tests, such as described above. In some embodiments, upper and lower limits of tonal and non-tonal bands may be computed based on the band structure. In some embodiments, multiple continuous DFT bins categorized as tonal may be consolidated into a single band. In some embodiments, category estimation may not be performed over 4000 Hz.

As shown in block 210 of FIG. 2, the apparatus 100 may include means, such as the processor 102, the memory 104, or the like, for performing spatial analysis. For example, in some embodiments the correlation across two channels (e.g. channels 2 and 3) may be computed for each band and the delay ($\tau_b$) that maximizes the correlation may be determined. The search range of the delay is limited to $[-D_{max}, D_{max}]$ and may be determined by distance between the microphones. The following equation calculates the estimation of delay, $S_2$ and $S_3$ are the DFT spectra of the signals captured at the second and third microphones:

$$\max_{\tau_b} R_e(S^b_{2,\tau_b}, {}^*S^b_{3,\tau_b}),$$

$$\tau_b \in [-D_{max}, D_{max}].$$

The delay may be transformed into an angle in azimuthal plane using basic geometry. The angle may be used to determine the spatial location of the source of the signal. Typically, the bands generated due to a source in a particular direction would result in similar value of azimuthal angle.

As shown in block 212 of FIG. 2, the apparatus 100 may include means, such as the processor 102, the memory 104, or the like, for performing source filtering and/or source manipulation. In some embodiments, the bands may be processed with appropriate Head Related Transfer Function (HRTF) filters, such as in binaural synthesis.

In some embodiments, bands categorized as tonal may constitute a directional component and the remaining spectral lines or bands may constitute the ambience component of the signal. A respective synthesis of these components may provide dominant and ambient signal separation. A clustering algorithm on the angles for different band may be used to reveal the distribution of audio components along spatial directions. In an alternative embodiment, for video containing two or three visible audio sources in the field of view, it may be possible to capture the rough directions of the sources from lens parameters. Such information can be used to segment the bands in specific directions and which may be synthesized to separately synthesize the sources. The sources identified in this manner need not be separated but the entire band could be translated, allowing source relocation to be realized with the same analysis-synthesis framework. In some embodiments, after the angles of arrival for tonal bands are obtained, pruning and/or cleaning operations may be carried out to improve the performance in cases of reverberant environments.

As shown in block 214 of FIG. 2, the apparatus 100 may include means, such as the processor 102, the memory 104, or the like, for performing synthesis of the multichannel signal. In some embodiments, an inverse DFT may be applied on the HRTF processed frames and add and overlap synthesis may be performed to obtain a temporal signal. In some example embodiments, in a multi-microphone to binaural capture synthesis, sum and difference signals may be derived from the signal acquired in channel 2 and channel 3 of the multichannel signal. In such embodiments, the sum component is used to estimate the angle and synthesis of the sum component is carried out independently from the difference component. The difference component and sum components are separately synthesized and added together to synthesize the binaural signal. In some embodiments, although angles may be computed from the sum signals, the spectrum of channel 1 may be used for synthesis. In some embodiments, no separate synthesis is carried out, but rather HRTF filtering is applied to the bands based on their tonal or non-tonal nature and a binaural signal is constructed.

As shown in block 216 of FIG. 2, the apparatus 100 may include means, such as the processor 102, the memory 104, or the like, for generating an output signal. For example, in some embodiments the output may be individual sources in the audio scene of the multichannel signal, a binaural signal, a modified multichannel signal, or a pair of dominant and ambient components. In various embodiments, the output may provide binaural synthesis, directional and diffused component separation, source separation, or source relocation within an audio scene.

In some example embodiments, the band structure used in the analysis-synthesis may be dynamic and may therefore adapt to dynamic changes in the signal. For example, if the spectral components of two sources overlap, when using a fixed band structure, there is no effective way to identify the two components within the band. However, with a dynamic band structure, the probability of each of these components being detected is higher. The probability of determining a correct direction for each tone is also higher leading to improved spatial synthesis. Additionally, with a fixed band structure multiple sources could be present or a single band could partially cover a spectral contribution due to a single audio source. Using a dynamic band structure overcomes this limitation by positioning bands around the tonal components.

A dynamic band structure may also allow different resolution across the frequency bands. The interval over which tonality detection happens may also be varied allowing the use of a narrower interval in lower frequency regions and a wider interval in the higher frequency regions.

FIG. 4 illustrates plots of the signal and analysis as provided in some of the embodiments described with regard to FIG. 2. Plot 402 of FIG. 4 illustrates a waveform of a signal being analyzed. Plot 404 of FIG. 4 illustrates a superimposed spectrum of the waveform frame and the tonality determinations. Plot 406 of FIG. 4 illustrates the goodness of fit statistic for each DFT bin.

An example of tonality determination performed by some embodiments of the present invention may now be described in conjunction with the operations illustrated in FIG. 5. In this regard, the apparatus 100 may include means, such as the processor 102, or the like, for computing the DFT spectrum of a multichannel signal. See block 502 of FIG. 5. For example, in one embodiment, the functions s(n) and w(n) are the signal function and the window function respectively. S(k) and W(k) are the DFT of the signal and window functions respectively. The spectrum of the signal may then be given by $$S(k)=\Sigma_{n=0}^{N-1}x(n)w(n)e^{-2\pi kn/N}.$$

The window function and the signal in that window are shown in FIG. 7. In some embodiments, a 48 KhZ sampling rate and a frame size of 20 ms may be used. An embodiment may use a 50% overlap with a previous frame for the analysis. In one embodiment, for example, 20 ms of audio data may be read in and then concatenated with 20 ms from the preceding frame that was previously processed making a window size of 40 ms to which the window function may be applied and the DFT computed. While a 50% overlap is provided as an example here, a different overlap may be used in other embodiments with appropriate changes to the analysis. In the embodiment, a sine window may be used for analysis, but may alternatively be any other suitable window selected for the analysis. The windowed signal may be zero padded to 8192 samples and the DFT may then be computed.

As shown in block 504 of FIG. 5, the apparatus 100 may also include means, such as the processor 102, or the like, for computing the normalized observed and expected spectral distributions, which are required to perform the goodness of fit test. For example, if $S_o$ and $S_e$ are the observed and expected (ideal) spectral shapes, the spectral shape in the region is captured by the spectral magnitude distribution over the interval $$S_o=\{S(k),S(k+1),\ldots,S(k+M_i-1)\}$$

and $$S_e=\{W(k),W(k+1),\ldots,W(k+M_i-1)\},$$

where $M_i$ is the size of interval over which goodness of fit is performed, and 'i' is used to index the interval size since multiple interval sizes may be used. The $S_o$ and $S_e$ cannot be used as is by themselves and should resemble the discrete probability density functions. Therefore, they are normalized with their sums over the interval and get $\overline{S_o}$ and $\overline{S_e}$, given by:

$$\overline{S}_o=\frac{s_o}{\sum_{m=0}^{M_i-1}s_o(m)}$$

and $$\overline{S}_e=\frac{s_e}{\sum_{m=0}^{M_i-1}s_e(m)}.$$

Example normalized expected and observed distributions are shown in FIG. 8.

As shown in block 506 of FIG. 5, the apparatus 100 may also include means, such as the processor 102, or the like, for computing the goodness of fit statistic. The normalized expected and observed distributions are the key inputs to the goodness of fit test. While an example embodiment is described using a chi-square goodness of fit test, embodiments of the present invention are not restricted to using a chi-square statistic, but rather any suitable other statistic may be used for this test. In some embodiments, the chi-square statistic may be modified with a suitable scaling before a hypothesis test is performed. In an example embodiment, the statistic is computed over the interval $M_i$ using:

$$\chi^2=\frac{\sum_{m=1}^{M_i-1}(\overline{S}_o[m]-\overline{S}_e[m])^2}{\overline{S}_e[m]}.$$

As shown in block 508 of FIG. 5, the apparatus 100 may also include means, such as the processor 102, or the like, for performing a hypothesis test. In an example embodiment, the hypothesis test requires the significance level, degrees of freedom for chi-square statistic and the actual statistic. The Null hypothesis is that a tonal component is found in the interval under consideration. This may happen if the normalized $S_e$ and $S_o$ closely match, which means the chi-square statistic is small in magnitude. The magnitude actually is used to derive the probability value from a chi-square cumulative distribution table of specific degree determined by $M_i$. The Null hypothesis is that a tone is present, at the spectral location around the interval. The Null hypothesis is rejected if the mismatch exceeds the probability value determined by the significance level. In alternative embodiments, the hypothesis for drawing an inference about the tonality of the band may be framed in another suitable way as well and is not restricted to the above described example.

As shown in block 510 of FIG. 5, the apparatus 100 may also include means, such as the processor 102, or the like, for determining a tonality decision for a band. In some embodiments, for each DFT bin in the spectrum for the preset significance level and the interval where a Null hypothesis is accepted, the band is classified as a tonal. Otherwise, if the Null hypothesis is rejected, the band is categorized as non-tonal. In some embodiments, the location of the tone is derived as centroid of the spectral region. The tonality decision may then be used in analysis and synthesis as provided in some of the embodiments described with regard to FIG. 2.

FIG. 6 provides a functional block diagram illustrating the operations for tonality determination as performed by an apparatus and described above in relation to FIG. 5.

FIG. 9 shows an example of the output that may be generated by operations as provided in some of the embodiments described with regard to FIG. 5. Plot 902 shows the waveform of the signal. Plot 904 shows a superimposed spectrum of the frame of the waveform and the tonality decisions and their starting marker points. Plot 906 shows the chi-square goodness of fit statistic for each of the DFT bins.

As described above, FIGS. 2 and 5 illustrate flowcharts of an apparatus, method, and computer program product according to example embodiments of the invention. It will be understood that each block of the flowchart, and combinations of blocks in the flowchart, may be implemented by various means, such as hardware, firmware, processor, circuitry, and/or other devices associated with execution of software including one or more computer program instructions. For example, one or more of the procedures described above may be embodied by computer program instructions. In this regard, the computer program instructions which embody the procedures described above may be stored by a memory 104 of an apparatus employing an embodiment of the present invention and executed by a processor 102 of the apparatus. As will be appreciated, any such computer program instructions may be loaded onto a computer or other programmable apparatus (e.g., hardware) to produce a machine, such that the resulting computer or other programmable apparatus implements the functions specified in the flowchart blocks. These computer program instructions may also be stored in a computer-readable memory that may direct a computer or other programmable apparatus to function in a particular manner, such that the instructions stored in the computer-readable memory produce an article of manufacture the execution of which implements the function specified in the flowchart blocks. The computer program instructions may also be loaded onto a computer or other programmable apparatus to cause a series of operations to be performed on the computer or other programmable apparatus to produce a computer-implemented process such that the instructions which execute on the computer or other programmable apparatus provide operations for implementing the functions specified in the flowchart blocks.

Accordingly, blocks of the flowchart support combinations of means for performing the specified functions and combinations of operations for performing the specified functions for performing the specified functions. It will also be understood that one or more blocks of the flowchart, and combinations of blocks in the flowchart, can be implemented by special purpose hardware-based computer systems which perform the specified functions, or combinations of special purpose hardware and computer instructions.

In some embodiments, certain ones of the operations above may be modified or further amplified. Furthermore, in some embodiments, additional optional operations may be included. Modifications, additions, or amplifications to the operations above may be performed in any order and in any combination.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

We claim:

1. A method comprising:

receiving a multichannel signal;

computing the spectrum for the multichannel signal;

determining tonality of bands within the spectrum;

generating a band structure for the spectrum;

performing spatial analysis of the bands;

performing source filtering using the bands;

performing synthesis on the filtered band components; and generating a binaural signal, wherein the tonality determination comprises comparing a normalized spectral component distribution in a band to an expected spectral component distribution.

2. A method according to claim 1 wherein determining the tonality of bands within the spectrum is performed on at least one channel in the multichannel signal.

3. A method according to claim 1 wherein determining the tonality of bands within the spectrum comprises determining if the band is tonal or non-tonal.

4. A method according to claim 1 wherein the width of the bands is variable.

5. A method according to claim 1 wherein the tonality determination of bands in the spectrum is based on statistical goodness of fit tests.

6. An apparatus comprising at least one processor and at least one memory including computer program instructions, the at least one memory and the computer program instructions configured to, with the at least one processor, cause the apparatus at least to:

receive a multichannel signal;

compute the spectrum for the multichannel signal;

determine tonality of bands within the spectrum;

generate a band structure for the spectrum;

perform spatial analysis of the bands;

perform source filtering using the bands;

perform synthesis on the filtered band components; and generate a binaural signal, wherein the apparatus is caused to generate a band structure for the spectrum by categorizing bands as tonal or non-tonal and computing upper and lower limits of tonal and non-tonal bands.

7. An apparatus according to claim 6 wherein determining the tonality of bands within the spectrum is performed on at least one channel in the multichannel signal.

8. An apparatus according to claim 6 wherein determining the tonality of bands within the spectrum comprises determining if the band is tonal or non-tonal.

9. An apparatus according to claim 6 wherein the width of the bands is variable.

10. An apparatus according to claim 6 wherein the tonality determination of bands in the spectrum is based on statistical goodness of fit tests.

11. An apparatus according to claim 6 wherein the tonality determination comprises comparing a normalized spectral component distribution in a band to an expected spectral component distribution.

12. An apparatus according to claim 11 wherein the expected spectral component distribution is generated by an ideal sinusoid.

13. An apparatus according to claim 11 wherein comparison of the spectral component distributions comprises using a test of goodness of fit.

14. An apparatus according to claim 6 wherein generating a band structure for the spectrum further comprises consolidating multiple continuous tonal bands into a single band.

15. An apparatus according to claim 6 wherein performing source filtering of the bands comprises processing the bands with head related transfer function (HRTF) filters.

16. An apparatus according to claim 6 wherein performing synthesis on the filtered band components comprises applying an inverse Discrete Fourier transform and applying add and overlap synthesis.

17. A computer program product comprising at least one non-transitory computer-readable storage medium bearing computer program instructions embodied therein for use with a computer, the computer program instructions comprising program instructions configured to:

receive a multichannel signal;

compute the spectrum for the multichannel signal;

determine tonality of bands within the spectrum;

generate a band structure for the spectrum;

perform spatial analysis of the bands;

perform source filtering using the bands;

perform synthesis on the filtered band components; and generate a binaural signal, wherein the program instructions configured to generate a band structure for the spectrum comprise program instructions configured to categorize bands as tonal or non-tonal and compute upper and lower limits of tonal and non-tonal bands.

18. An apparatus comprising:

means for receiving a multichannel signal;

means for computing the spectrum for the multichannel signal;

means for determining tonality of bands within the spectrum;

means for generating a band structure for the spectrum;

means for performing spatial analysis of the bands;

means for performing source filtering using the bands;

means for performing synthesis on the filtered band components; and means for generating a binaural signal, wherein the tonality determination comprises comparing a normalized spectral component distribution in a band to an expected spectral component distribution.

19. A method comprising:

receiving a multichannel signal;

computing the spectrum for the multichannel signal;

determining tonality of bands within the spectrum;

generating a band structure for the spectrum;

performing spatial analysis of the bands;

performing source filtering using the bands;

performing synthesis on the filtered band components; and generating a binaural signal, wherein generating a band structure for the spectrum comprises categorizing bands as tonal or non-tonal and computing upper and lower limits of tonal and non-tonal bands.

20. An apparatus comprising at least one processor and at least one memory including computer program instructions, the at least one memory and the computer program instructions configured to, with the at least one processor, cause the apparatus at least to:

receive a multichannel signal;

compute the spectrum for the multichannel signal;

determine tonality of bands within the spectrum;

generate a band structure for the spectrum;

perform spatial analysis of the bands;

perform source filtering using the bands;

perform synthesis on the filtered band components; and generate a binaural signal, wherein the tonality determination comprises comparing a normalized spectral component distribution in a band to an expected spectral component distribution.

* * * * *